US005157420A

United States Patent [19]

Naka et al.

[11] Patent Number: 5,157,420

[45] Date of Patent: Oct. 20, 1992

[54] INK JET RECORDING HEAD HAVING REDUCED MANUFACTURING STEPS

[76] Inventors: Takahiro Naka; Kazuhiko Hara; Noriaki Okazawa; Seiji Mochizuki, all of c/o Seiko Epson Corporation, 3-5, Owa 3-chome, Suwa-shi, Nagano, Japan

[21] Appl. No.: 567,507

[22] Filed: Aug. 15, 1990

[30] Foreign Application Priority Data

| | | | |
|---|---|---|---|
| Aug. 17, 1989 | [JP] | Japan | 1-211583 |
| Mar. 19, 1990 | [JP] | Japan | 2-68735 |
| Mar. 19, 1990 | [JP] | Japan | 2-68736 |

[51] Int. Cl.[5] ..... B41J 2/045

[52] U.S. Cl. ..... 346/140 R

[58] Field of Search ..... 346/140

[56] References Cited

U.S. PATENT DOCUMENTS

| | | | |
|---|---|---|---|
| 4,216,477 | 8/1980 | Matsuda | 346/140 |
| 4,521,788 | 6/1985 | Kimura | 346/140 |
| 4,611,219 | 9/1986 | Sugitani et al. | 346/140 |
| 4,635,079 | 1/1987 | Hubbard | 346/140 |
| 4,680,595 | 7/1987 | Cruz-Uribe et al. | 346/140 |
| 4,769,654 | 9/1988 | Tanaka | 346/140 |

FOREIGN PATENT DOCUMENTS

| | | |
|---|---|---|
| 0207568 | 6/1986 | European Pat. Off. . |
| 2182611 | 11/1986 | European Pat. Off. . |
| 3204662 | 8/1983 | Fed. Rep. of Germany . |
| 56-172 | 1/1981 | Japan . |
| 63-280649 | 12/1987 | Japan . |

*Primary Examiner*—Joseph W. Hartary

[57] ABSTRACT

An inkjet recording head having a head substrate (1); at least a group of pressure chambers (2) arranged so as to be recessed over an entire surface of the head substrate; ink ejecting nozzles (7), each of which is opened so as to face a surface opposite to that of the substrate by extending through a flow path (5) that passes through the head substrate thicknesswise from one end of each of the pressure chambers; and an annular ink preparation chamber (4) communicating with the other end of each of the pressure chambers. The ink preparation chamber that communicates with each of the pressure chambers is arranged so as to be annular, thereby improving the air bubble discharging characteristics and preventing disruption of ink ejection. In addition, the advantage that the ink can be supplied to each of the ink ejecting nozzles uniformly ensures excellent printing quality. Furthermore, the ink chamber is recessed into an opposite surface of the head substrate opposite the pressure chambers.

5 Claims, 9 Drawing Sheets

INK JET RECORDING HEAD HAVING REDUCED MANUFACTURING STEPS

BACKGROUND OF THE INVENTION

This invention relates to an ink jet recording head that forms an image on a recording medium by ejecting ink droplets.

To achieve high quality printing with on-demand type ink jet recording apparatuses, it is necessary to increase their nozzle density. To this end, the specifications of U.S. Pat. Nos. 4,680,595 and 4,611,219, or Japanese Patent Laid-Open Publication No. 172/1981 propose ink jet recording heads that are constructed so that an array of nozzles formed on a common substrate is interposed by a group of pressure chambers so as to cause each pressure chamber to face each nozzle to thereby form a high density nozzle structure. These ink jet recording heads have a U-shaped ink preparation chamber which is arranged so as to not only surround one end of the group of pressure chambers but also to communicate with each of them.

However, in such a head structure, the U-shaped ink preparation chamber has a dead end. Once air bubbles are admitted into the ink preparation or supply chamber and remain in the dead end, it is difficult to purge them out. Also, with the U-shaped ink preparation chamber, the ink supply capacity differs between pressure chambers and this causes inconsistency in ink ejection characteristics such as the ink droplet diameter and ink ejection rate, thus presenting the problem of deteriorating the printing quality of the head.

SUMMARY OF THE INVENTION

Therefore, the present invention has been made in view of these circumstances and has as an object the provision of an ink jet recording head capable of easily eliminating air bubbles, maintaining a consistent ink supply capacity, and providing an excellent printing quality.

Furthermore, the pressure chambers are recessed into one surface of a head substrate, whereas an ink chamber is recessed into an opposite surface thereof. The pressure chamber 2 are recessed into one surface of a head substrate, whereas an ink chamber is recessed into an opposite surface thereof. The pressure chamber and the ink chamber are communicated with each other through an ink flow channel 14 which is provided in the thickness direction of the head substrate. Therefore, the pressure chamber and the ink chamber can be formed at the same time by injection molding on both surfaces of the head substrate when forming the substrate, as a result of which the number of manufacturing steps required is reduced and the overall manufacturing difficulty is greatly reduced.

The ink jet recording head according to the present invention comprises: a head substrate; at least a group of pressure chambers arranged so as to be recessed over an entire surface of the head substrate; ink ejecting nozzles, each of which is opened so as to face a surface opposite to that of the substrate by extending through a flow path that passes through the head substrate thicknesswise from one end of each of the pressure chambers; and an annular ink preparation chamber communicating with the other end of each of the pressure chambers.

DETAILED DESCRIPTION OF THE PREFERRED EMBODIMENTS

Figure 1A:
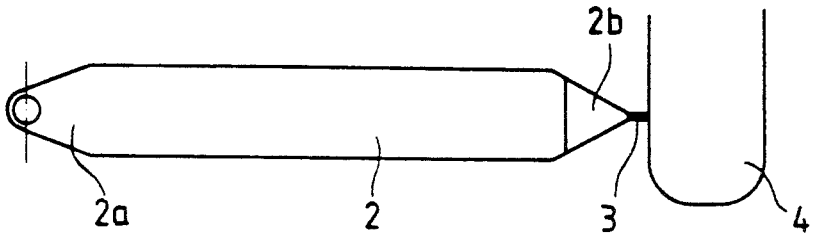
FIGS. 1 (a) and 1 (b) are a plan view and a section view showing a flow path structure of an ink jet recording head according to an embodiment of the present invention.
Figure 1B:
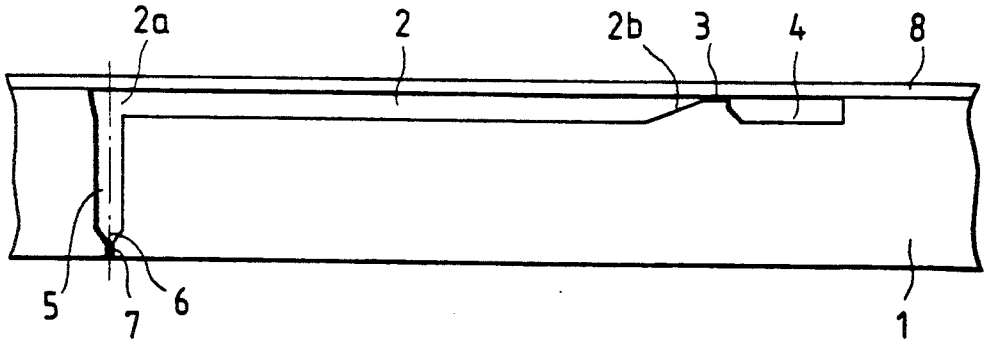

FIGS. 1 (a) and 1 (b) are a plan view and a sectional view, respectively, showing a flow path structure of an ink jet recording head according to one embodiment of the present invention. A head substrate 1 is formed by injection molding a high molecular weight resin such as polysulfone, polyether sulfone, or polycarbonate, or by photoetching a piece of glass. On a first surface of the head substrate 1, there is provided a series .of ink flow path grooves each consisting of a pressure chamber 2, a constricted portion 3, and an ink preparation or supply chamber 4. The series of the flow path grooves is arranged coplanar on the head substrate so as to form recesses. Further, a liaison flow path 5 that passes through the head substrate 1 thicknesswise from one end 2*a* of the pressure chamber 2, and an orifice 6 are connected to the flow path grooves. On a second surface opposite to the first surface (on which the flow path grooves are arranged) is a nozzle 7 opened to eject a droplet of ink that has passed through the orifice 6. The actual ink flow path is completed by bonding a vibrating plate 8 made of the same material as the head substrate on the flow path groove formed surface of the head substrate using a solvent such as triethylene glycol dibutylether.

On the vibrating plate 8 is an electrode formed of either a metal plate or a metal film such as an indium-tin oxide film (ITO film) to provide a common electrode. A piezoelectric element is bonded to the electrode in a position corresponding to the pressure chamber. Additional features including a signal line, an ink supply pipe, and a head cover are assembled to form the entire ink jet recording head.

Figure 2:
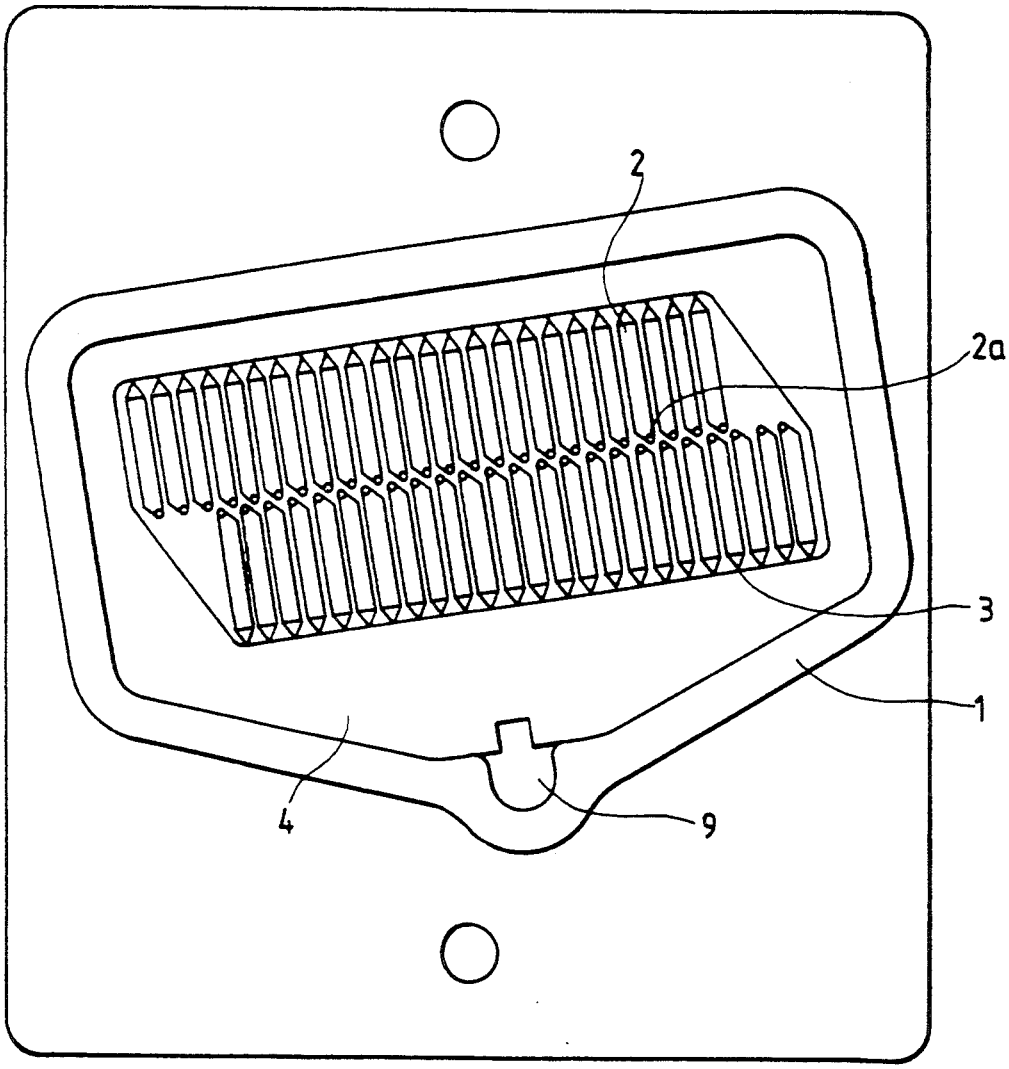
FIG. 2 is a plan view showing an ink jet recording head according to an embodiment of the present invention having the structure of the flow path shown in FIGS. 1 (a) and 1 (b)

FIG. 2 shows an ink jet recording head according to an embodiment of the present invention having the flow path structure shown in FIGS. 1 (a) and 1 (b). On one side of a head substrate 1 are two rows of pressure chambers 2. As shown in FIG. 1 (b), the end 2*a* of each of the pressure chambers 2 communicates with the ink ejecting nozzle 7 through the liaison flow path 5 and the orifice 6. The other end 2*b* of each of the pressure chambers 2 communicates with the ink preparation chamber 4 through the constricted portion 3 that is shallower than the pressure chamber 2. This constricted portion 3 serves to prevent pressure loss in a direction opposite to ink injection, and is constructed so that the constricted portion is coplanar with the pressure chamber 2 and ink preparation chamber 4 and has no bent portion the absence of which facilitates smooth flow of air bubbles at the time the air bubbles are discharged. The ink preparation chamber 4 is annularly arranged so as to surround the two rows of pressure chambers 2. Ink is supplied from an ink supply pipe 9.

According to the above embodiment, the ink preparation chamber 4 communicating with each of the pressure chambers is arranged in annular form so that the group of pressure chambers can be surrounded thereby. This allows the ink from the ink supply pipe 9 to be guided into each pressure chamber by the sucking force of the nozzle even when air bubbles are present in the ink preparation chamber, in which case the elimination of the air bubbles is easily accomplished. Also, the ink can be supplied from the ink supply pipe 9 to the remotely located pressure chambers consistently and allowing no difference in the ink supply condition for each ejecting nozzle, thus promoting uniform ink ejection.

Although in this embodiment pressure chambers are arranged in two rows, they may be arranged in only one row.

Further, the annular ink preparation chamber 4 is desirably formed in a smooth profile with corners chamfered to enhance air bubble elimination.

Figure 3:
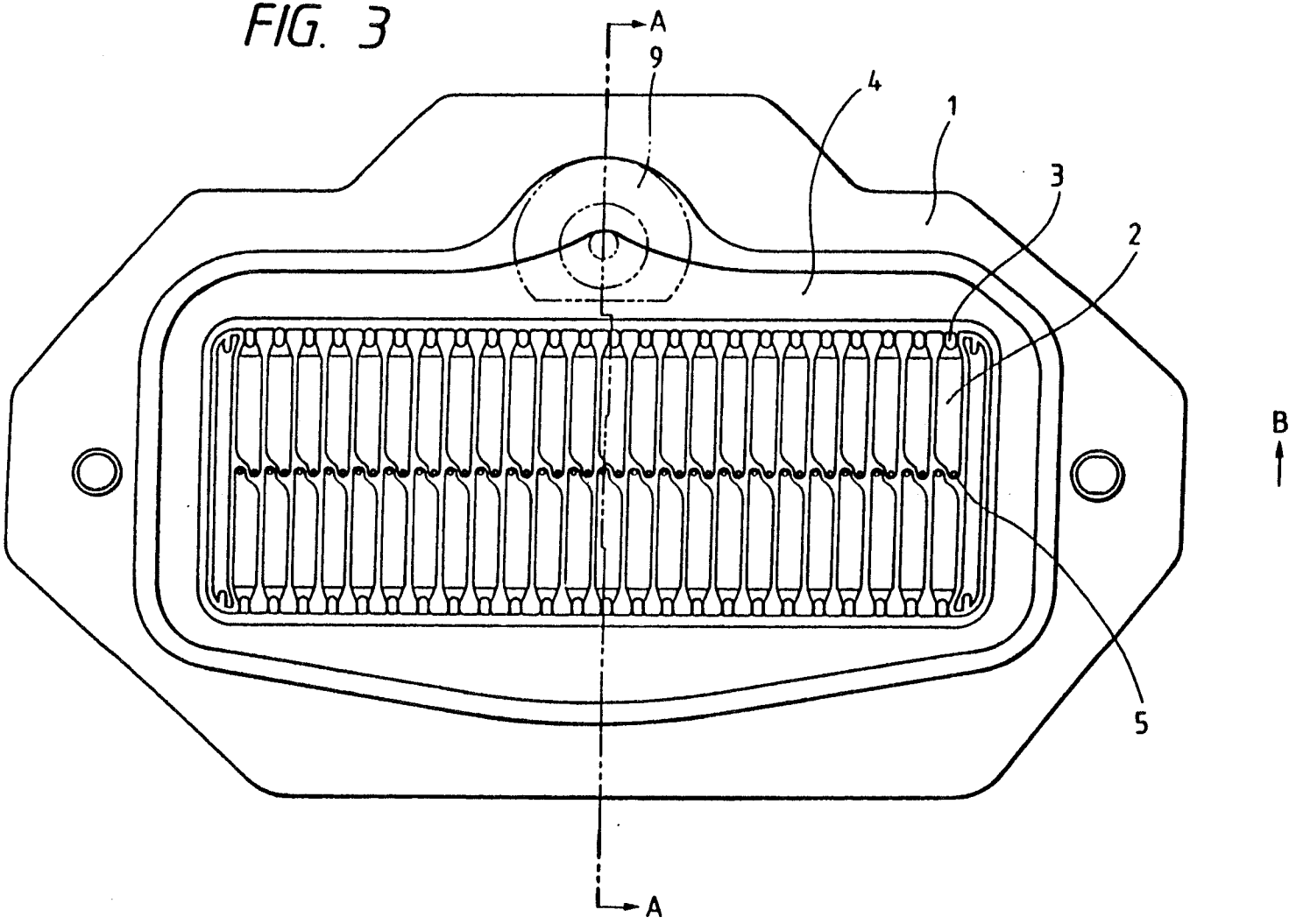
FIG. 3 is a plan view of an ink jet recording head according to another embodiment of the present invention.
Figure 4:
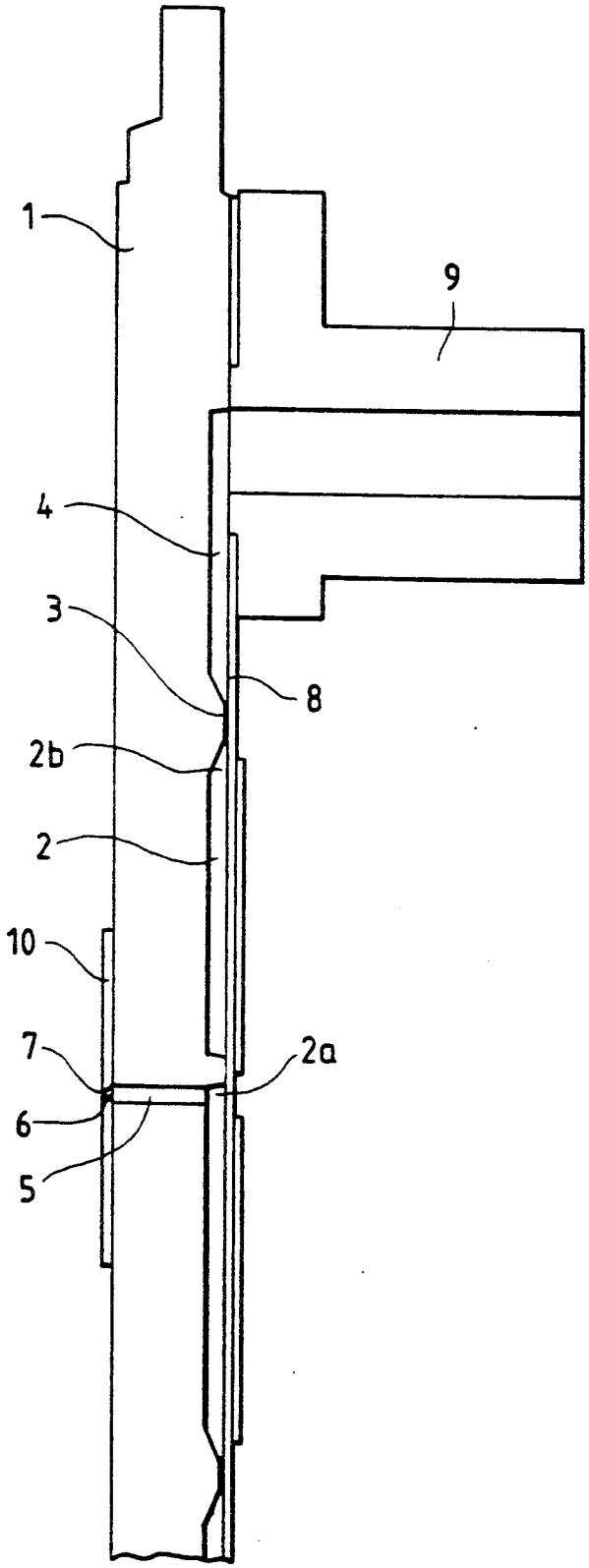
FIG. 4 is a sectional view taken along the line A—A of FIG. 3.

FIG. 3 is a plan view of an ink jet recording head according to another embodiment of the present invention, and FIG. 4 is a sectional view taken along the line A—A of FIG. 3. In FIG. 3, the nozzles 7 and the vibrating plates 8 shown in FIG. 4 have been omitted.

A head substrate 1 made of a plastic material has on one of its sides a series of flow paths including pressure chambers 2 and an ink preparation chamber 4 formed by injection molding. One end 2*b* of each of the pressure chambers 2 communicates with the ink preparation chamber 4 through a constricted portion 3 and the other end 2*a* of each of the pressure chambers 2 communicates with a nozzle 7 formed on a nozzle plate 10 by passing through the head substrate 1 thicknesswise through a liaison flow path 5 and an orifice 6. A thin vibrating plate 8 is bonded on the side of the head substrate 1.

The ink preparation chamber 4 for supplying the ink to each of the pressure chambers 2 is annularly arranged so as to surround all the pressure chambers and to be coplanar therewith, and communicates with each pressure chamber through a corresponding constricted portion 3 along its inner periphery. The ink preparation chamber 4 is constructed to be wide in cross section toward the center (when viewed vertically as in FIG. 3) and becomes gradually narrow toward both sides.

Ink is filled in the head by ink filling means such as a pump. The ink from an ink tank (not shown) is guided into the chamber 4 through the ink supply pipe 9 vertically with respect to the head substrate 1 when FIG. 3 is viewed from the front. In FIG. 3 the ink supply pipe 9 is indicated by a two-dot chain line. The admitted ink expands within the ink preparation chamber 4, advances to each pressure chamber 2, and then to the liaison flow path 5, the orifice 6, and the ink ejecting nozzle 7.

Figure 5:
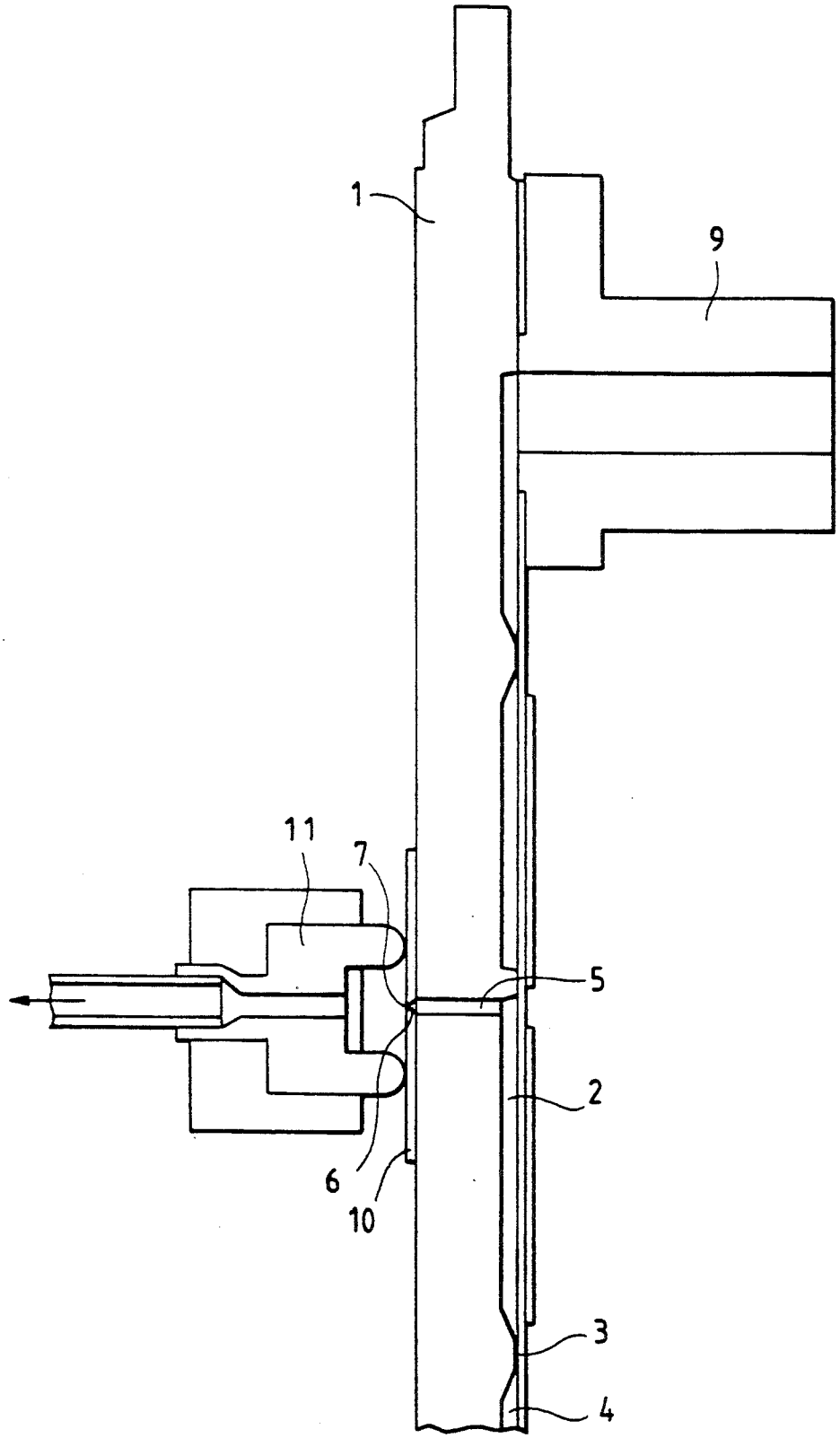
FIG. 5 is a sectional view showing the state in which the ink is being sucked in the embodiment shown in FIG. 4.

FIG. 5 shows the state in which the ink is being sucked by a suction pump with a suction cap 11 clamped onto the nozzle plate 10 to fill the head or to drive air bubbles out.

As described above, since the ink preparation chamber 4 is annularly arranged, it has no dead ends and can therefore provide excellent performance in ink filling and air bubble elimination.

When the head substrate 1 is vertically disposed or a recording apparatus such that the upward direction is indicated by the arrow B as shown in FIG. 3, if the ink supply pipe 9 is coupled to the ink preparation chamber in the upper portion thereof, it is possible to enhance the ink filling performance and air bubble discharging performance.

When the ink is sucked to fill the head by disposing the head substrate 1 on the recording apparatus so that the direction indicated by the arrow B (FIG. 3) is upwardly oriented, and the ink is again sucked as shown in FIG. 5, the ink flows coming from both sides meet at the center in the lower portion of the ink preparation chamber 4. An air bubble is again produced in the portion where the ink is absent, i.e., at this meeting point, buoyantly rises, is drawn into the pressure chambers 2 by the suction force, and is discharged outside through the ink ejection nozzle(s) 7.

The performance of filling the ink into the ink preparation chamber 4 can be further enhanced by arranging a supply inlet of the ink supply pipe 9 so as to be in contact with the outer periphery of the ink preparation chamber 4 as shown by the embodiment of FIG. 3.

In the case of the head substrate 1 shown in FIG. 3, a row of nozzles arranged in a straight line is mounted on the recording apparatus slightly inclined so that dots required to achieve a desired resolution can be formed vertically when the head substrate 1 is moved horizontally.

Figure 6:
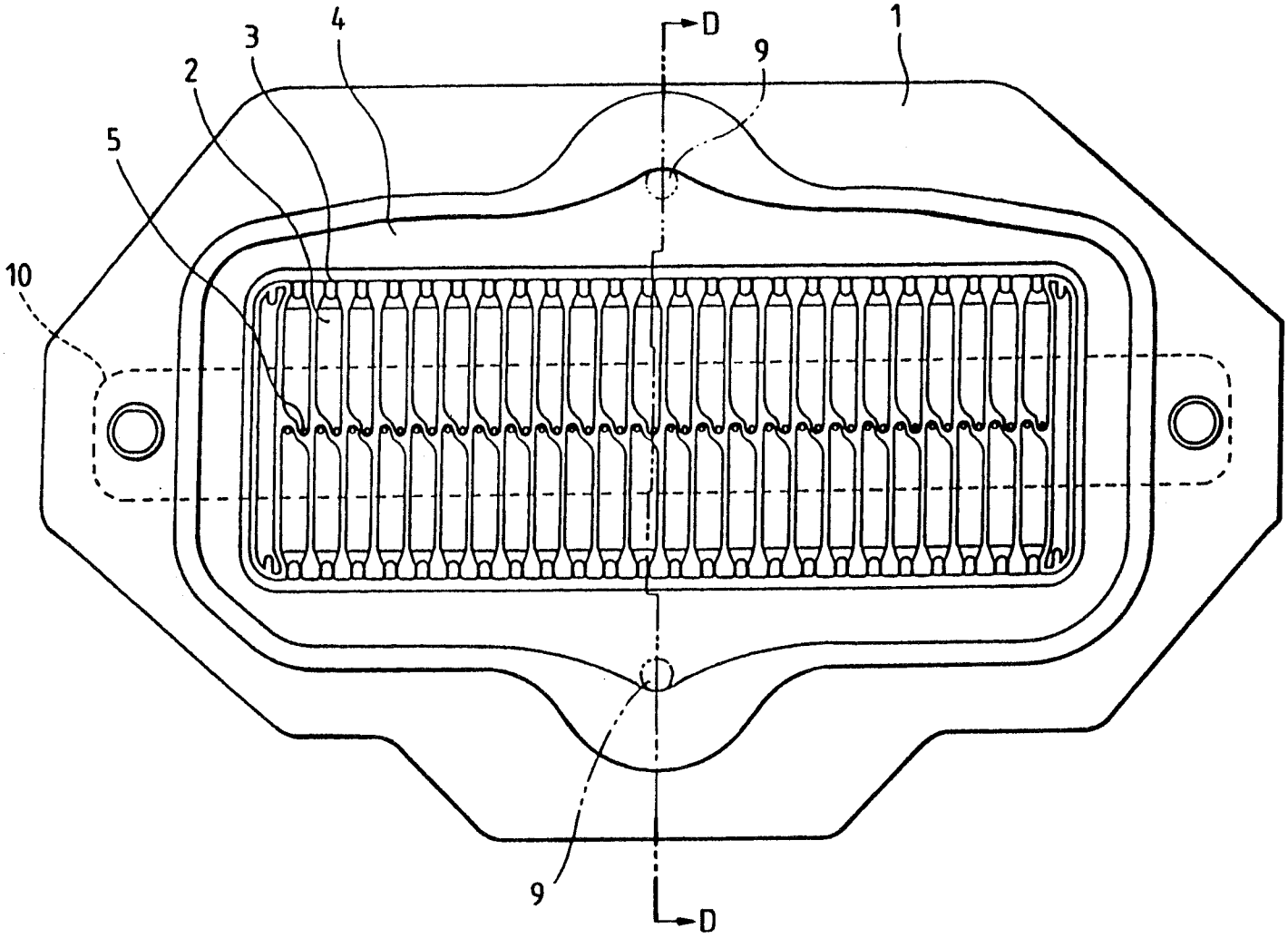
FIG. 6 is a plan view of an ink jet recording head according to still another embodiment of the present invention.
Figure 7:
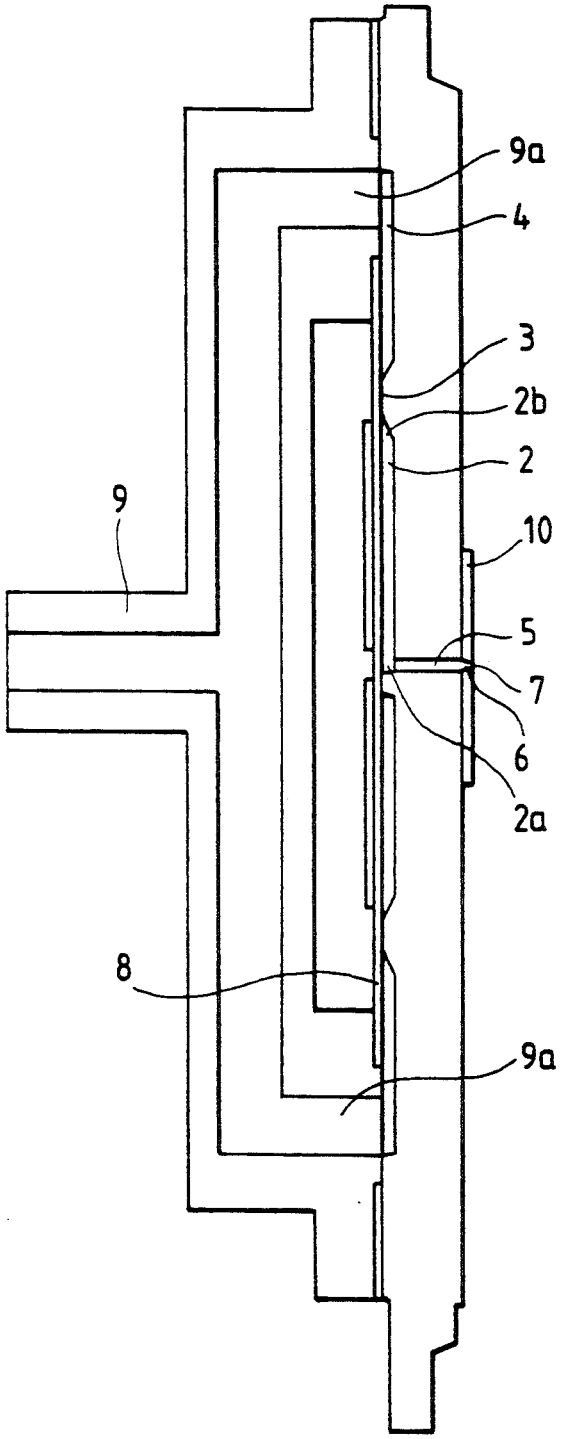
FIG. 7 is a sectional view taken along the line D—D of FIG. 6.

FIG. 6 is a plan view showing an ink jet recording head which is still another embodiment of the present invention, and FIG. 7 is a sectional view taken along the line D—D of FIG. 6. The ink ejecting nozzles 7, vibrating plates 8, and ink supply pipe 9 shown in FIG. 7 have been omitted from FIG. 6. Although the construction of the flow path grooves including the pressure chambers 2 is substantially the same as those of the embodiment shown in FIG. 3, in the present embodiment, the ink is supplied to the ink preparation chamber 4 through ink supply pipes 9 connected to respective centers of the upper and lower portions of the ink preparation chamber 4 as viewed vertically.

The ink is filled in the head by ink filling means such as a pump. The ink from an ink tank (not shown) is guided into the ink preparation chamber 4 through the ink supply pipe 9 vertically with respect to the head substrate 1 when FIG. 6 is viewed from the front. In FIG. 6 the ink supply pipe 9 is indicated by a two-dot chain line. The admitted ink expands within the ink preparation chamber 4, advances to each pressure chamber 2, then to the liaison flow path 5, the orifice 6, and the ink injecting nozzle 7.

Figure 8:
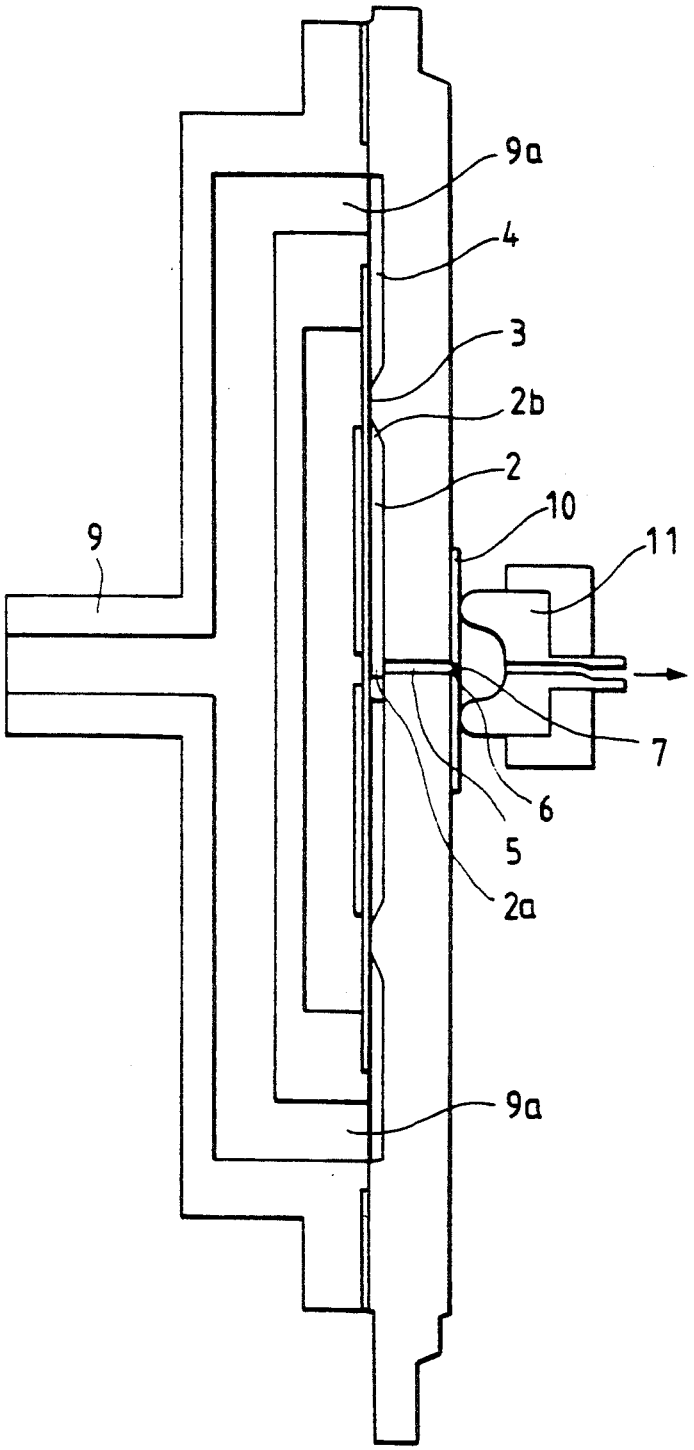
FIG. 8 is a sectional view showing the state in which the ink is being sucked in the embodiment shown in FIG. 7.

FIG. 8 shows the state in which the ink is being sucked by a suction pump with a suction cap 11 clamped onto the nozzle plate 10 in order to fill the head or to drive air bubbles out.

When the head is filled with ink, by sucking the ink as shown in FIG. 8, through two supply inlets 9*a* shown in FIG. 6, the vertically extending ink flows meet at the horizontal center. An air bubble produced in the portion where the ink is absent, i.e., in the dead space where the two opposed ink flows meet, buoyantly rises, is drawn into the pressure chambers 2 by the suction force, and is discharged outside through the ink ejecting nozzle(s) 7.

Although two supply inlets 9*a* are provided in the present embodiment, more inlets may reduce the portion(s) where the ink is absent within the ink preparation chamber 4, thereby reducing the time required to fill the head with ink.

Figure 9:
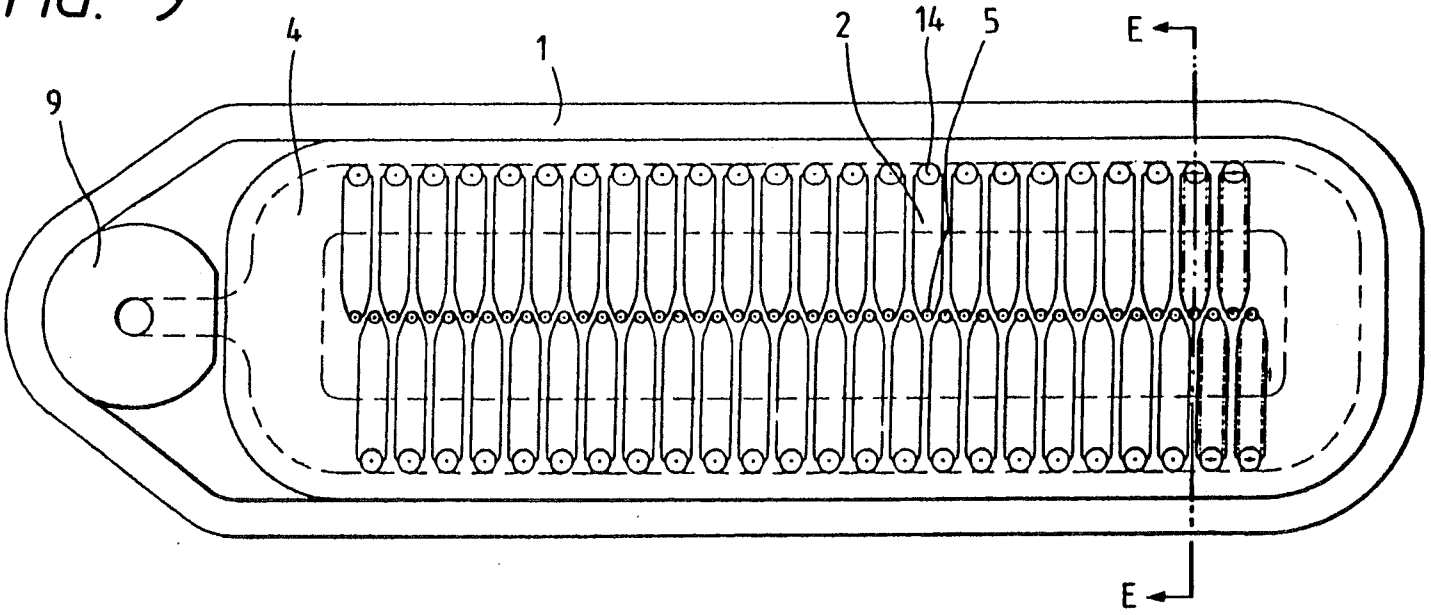
FIG. 9 is a plan view of an ink jet recording head according to yet another embodiment of the present invention.
Figure 10:
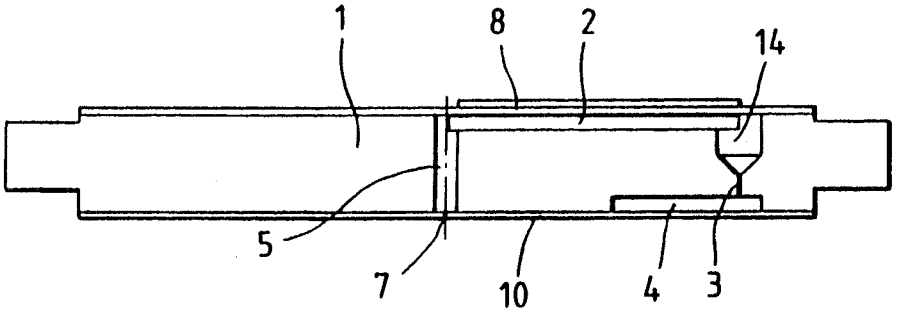
FIG. 10 is a sectional view taken along the line E—E of FIG. 9.

FIG. 9 is a plan view showing an ink jet recording head according to another embodiment of the present invention, and FIG. 10 is a sectional view taken along the line E—E of FIG. 9. The vibrating plates 8 shown in FIG. 10 are omitted in FIG. 9. Also, members which are the same as those in other embodiments are designated by the same reference numerals and the descriptions thereof are omitted.

In this embodiment, an ink preparation chamber 4 communicating with pressure chambers 2 is arranged on a surface opposite to the surface of a head substrate 1 on which the pressure chambers 2 are formed. Each of the pressure chambers 2 communicates with the ink preparation chamber 4 through a supply path 14 that passes through the head substrate 1 thicknesswise from one end 2*b* of the pressure chamber(s), and constricted portion(s) 3. The ink preparation chamber 4 is formed so as to overlap the pressure chambers 2 as shown by a broken line in FIG. 9. This makes it possible to reduce the width of the head, which in turn allows a sheet forwarding roller to be located near the row of ink ejecting nozzles. Thus, the printing area in the recording sheet can be increased.

In the present embodiment, each supply path 14 has its circular hole injection-formed and its constricted portion 3 machined using a laser beam. Accordingly, it is not required that these tiny constricted portions be injection-formed (as in the embodiments shown in FIGS. 1 to 8), thus resulting in an easier and accurate forming process. In addition, because the constricted portions are not bonded to the vibrating plate 8, each constricted portion is unlikely to collapse.

Furthermore, in the embodiment of FIGS. 9 and 10, the ink supply pipe 9 is connected on one side of the group of pressure chambers. Such an arrangement gives the head no portion projecting in the sheet forwarding direction and, as a result, the head does not touch the recording sheet curled by the swelling of the ink after printing, thereby preventing the contamination of the recording sheet by the ink. According to the present invention, the ink preparation chamber that communicates with each of the pressure chambers is arranged so as to be annular, thereby improving the air bubble discharging characteristics and preventing disruption of ink injection. In addition, the advantage that the ink can be supplied to each of the ink ejection nozzles uniformly ensures excellent printing quality.

What is claimed is:

1. An ink jet recording head, comprising:

a generally planar head substrate;

a plurality of pressure chambers recessed into a first surface of said substrate;

an equal plurality of ink ejecting nozzles (7), each of which opens at a second , opposite surface of said substrate through a flow path (5) that passes through said substrate and openly communicates with one end (2*a*) of an associated pressure chamber (2); and an ink chamber (4) recessed into said second surface of said head substrate, said ink chamber (4) communicating with another end of each of said pressure chambers (2) through a flow path (14) the passes through said head substrate thicknesswise.

2. An ink jet recording head according to claim 1, wherein said flow path (14) has a constricted portion.

3. An ink jet recording head according to claim 2, wherein said head substrate is formed by injection molding a high molecular weight resin, wherein plates made of the same material as said head substrate are bonded over said group of pressure chambers and said ink chamber, and wherein said constricted portion of said flow path is machined using a laser beam.

4. An ink jet recording head according to claim 1, wherein said ink chamber overlaps said pressure chambers.

5. An ink jet recording head according to claim 1, wherein said ink chamber is annular and surrounds said plurality of pressure chambers.

* * * * *